US005140564A

United States Patent [19]

Rich

[11] Patent Number: 5,140,564

[45] Date of Patent: Aug. 18, 1992

[54] EXAM TIMER

[76] Inventor: Patrick M. Rich, 1301 Ashover, Bloomfield Hills, Mich. 48013

[21] Appl. No.: 600,583

[22] Filed: Oct. 19, 1990

[51] Int. Cl.[5] ..... G04F 7/00

[52] U.S. Cl. ..... 368/107; 368/111

[58] Field of Search ..... 368/89, 107, 110, 111, 368/112, 113, 250, 251

[56] References Cited

U.S. PATENT DOCUMENTS

| | | | |
|---|---|---|---|
| 3,624,926 | 10/1970 | McCaughy | 368/107 |
| 4,451,158 | 5/1984 | Selwyn et al. | 368/63 |
| 4,993,004 | 2/1992 | Loizeaux | 368/107 |
| 4,995,018 | 2/1991 | Edwards | 368/107 |

*Primary Examiner*—Bernard Roskoski
*Attorney, Agent, or Firm*—Krass & Young

[57] ABSTRACT

A timing device for pacing an examinee through a timed, multi-question examination. The device includes means for inputting a plurality of signals corresponding to a number of questions and a time interval for answering them. Memory means are provided for storing the signals. The device includes a clock means for generating a real time signal indicative of the current time. A central processor determines a response time interval for answering each question by dividing the total time interval by the number of questions. The CPU successively decrements the total time interval by the response time interval until the total time interval is zero, at the same time successively incrementing the number of questions by one each time the total time interval is decremented. These changing values are continuously displayed on an LCD display. By observing the display, the examinee may readily determine how much time is left until the end of the exam, and what question he/she should be answering to finish the examination in time.

20 Claims, 3 Drawing Sheets

EXAM TIMER

BACKGROUND OF THE INVENTION

1. Field of the Invention

This invention relates generally to the field of timing and countdown devices, and more particularly, to such a device for pacing an examinee through an examination so that the examinee may determine the time remaining until the examination is over and the question number he/she should be answering in order to complete the examination on time.

2. Description of the Relevant Prior Art

Various types of timing and countdown devices have, of course, long been known in the prior art. For example, devices such as alarm clocks, stove timers, etc. may be set such that they signal the user at a particular, preset time. In the case of an alarm clock, the device may be preset to sound its signal at a particular time of the day. In the case of a device such as a stove timer, the device may be set to go off after a certain interval of time has elapsed.

It is also known to construct a timing device which is capable of counting down predetermined intervals of time and periodically signaling the progressive elapse of the countdown periods. For example, U.S. Pat. No. 4,451,158 discloses such as countdown timer that employs a voice synthesizer to announce the progressive elapse of the countdown periods.

However, there is no known prior art timing or countdown device that is suitable for use in an examination setting. In an examination containing a plurality of questions and having a fixed period of time in which to answer all of the questions, many examinees try to pace themselves through the examination by dividing the total time period by the number of questions to determine a response period, and allocating one such response period per question. By spending no longer than the response period on each question, the examinee will be able to finish the examination in time.

While, in theory, this approach is appealing, up until the device of the present invention there has been no practical way of fully implementing this approach. The examinee may provide himself/herself with a watch, and by counting from the time the examination begins, may be able to figure out at which time each question should be answered. However, this approach is impractical for examinations with a large or odd number of questions, and also suffers from the disadvantage that most examinations do not begin at a convenient starting time, such as the start of a hour. Thus, the examinee may have 47 questions to complete in 2½ hours, and the examination may begin at 2:17. Under these circumstances, using nothing but a watch to pace oneself through the examination is impractical.

Additionally, the examinee may also wish to know what question he or she should be answering at a particular time. Thus, in the example given above, the examinee may wish to know how many questions he should have answered by 4:15. Obviously, a conventional watch or prior art timing device such as a stop watch, etc., cannot practically be utilized to provide this pacing information.

It would be desirable if an examinee could easily determine how much time to devote to each question on a multi-question, timed exam, and ascertain which question she should be answering at a particular time to finish the examination on time.

It would be particularly desirable if an examinee could pace himself through a multi-question, timed examination by the use of a device which is both inexpensive, reliable, and simple to operate.

SUMMARY OF THE INVENTION

Disclosed and claimed herein is a timing device for pacing an examinee through an examination having a number of questions and a time interval in which to answer the questions. In its most fundamental aspect, the timing device includes internal clock means, input means, memory means, control means, and display means. Preferably, some or all of these components comprise a single integrated circuit and are contained inside a housing for protectively encasing them.

The clock means generates a real time signal indicative of the present time. The input means allows the operator to enter a plurality of signals corresponding to the number of questions on the exam and the time interval in which to answer them. The memory means stores the inputted plurality of signals. The control means, which is connected to the clock means, the memory means, the input means and the display means, is operative to determine a response time in which to answer each of the questions by dividing the time interval by the number of questions. The control means is further operative to successively decrement the time interval by the response time until the time interval equals zero, and successively increment the number of questions by one each time the time interval is decremented. The control means is further operative to successively generate time and number signals corresponding to the successively decremented time intervals and incremented number of questions, respectively. The display means displays the time and number signals successively generated by the control means. Thus, the examinee may determine from observing the display means both the time interval remaining until the examination is over and the question number she should be answering in order to complete the examination on time.

In a further aspect of the timing device of the present invention, the display means further comprises means for entering a plurality of signals corresponding to the current time, the control means being further operative to continuously update the inputted current time signals. The display means further includes means for displaying the continuously updated current time signals; i.e., the timing device can also be used as a conventional clock or watch. Thus, the examinee may determine at a glance both the current time, the amount of time left in the examination and the question he should be answering.

In yet another aspect of the present invention, the operator controlled input means comprises a plurality of switches. Thus, by successive activation of various combinations of switches, the operator may enter both the number of questions in the examination and the duration of the examination, as well as the current time in those embodiments which incorporate that additional feature.

Furthermore, the device of the present invention may also incorporate start switch means in communication with the control means such that, when the start switch is activated, the control means begins successively decrementing the time interval and incrementing the number of questions. Thus, the examinee may input the number of questions and the examination time period into the device before the examination starts. As soon as the examination starts, the examinee may then activate the start switch so that the device begins keeping track of the time interval and number of questions.

In order to facilitate the input of data into the device, the device may further comprise a mode switch for switching the device between a setting mode, which permits entry of data, and a running mode. When the mode switch is in the setting mode, the operator may input time and number signals by successive activation of the plurality of switches, as described above. At any time after the device has been set, the operator may use the mode switch to switch the device into the running mode, at which time the control means will begin successively decrementing the time interval and incrementing the number of questions, thus beginning the countdown.

BRIEF DESCRIPTION OF THE DRAWINGS

The following detailed description may best be understood by reference to the following drawing in which.

DETAILED DESCRIPTION OF THE PREFERRED EMBODIMENTS

Figure 1:
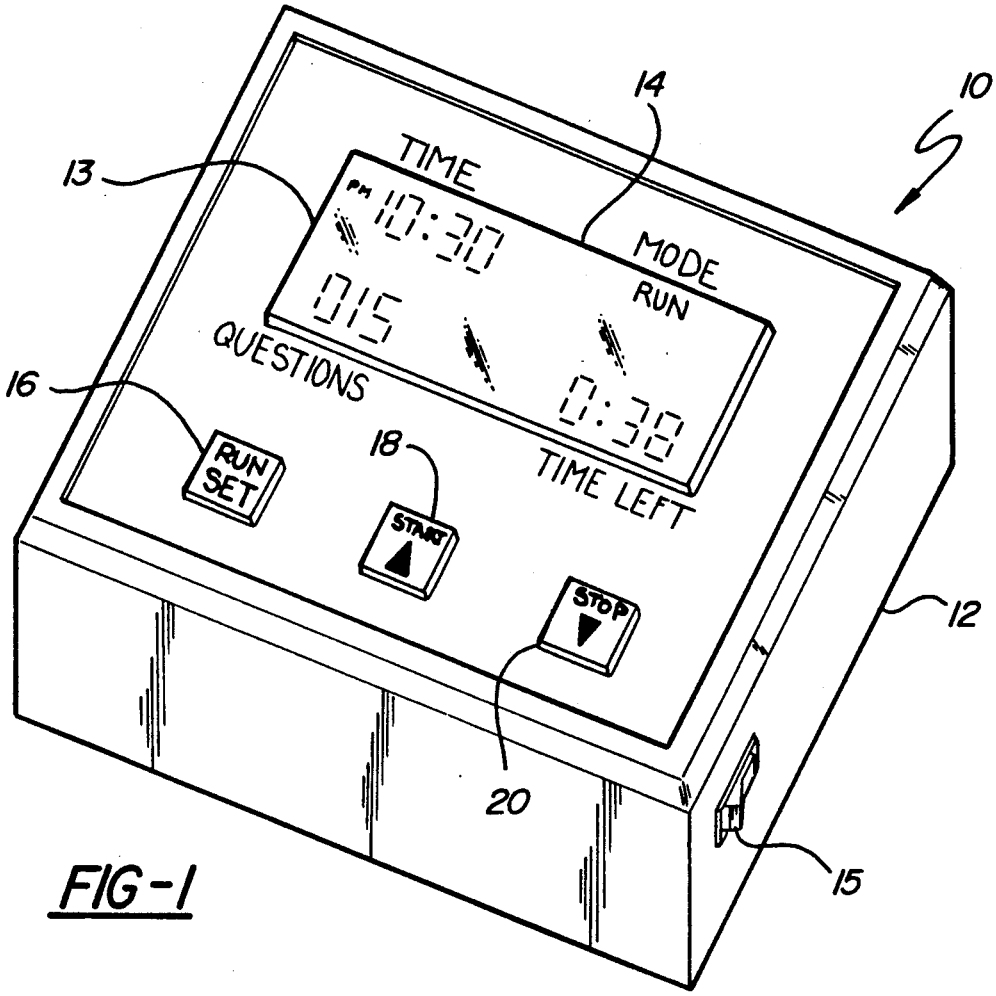
FIG. 1 is a perspective view of an exam timer constructed according to the teachings of the present invention.
Figure 2:
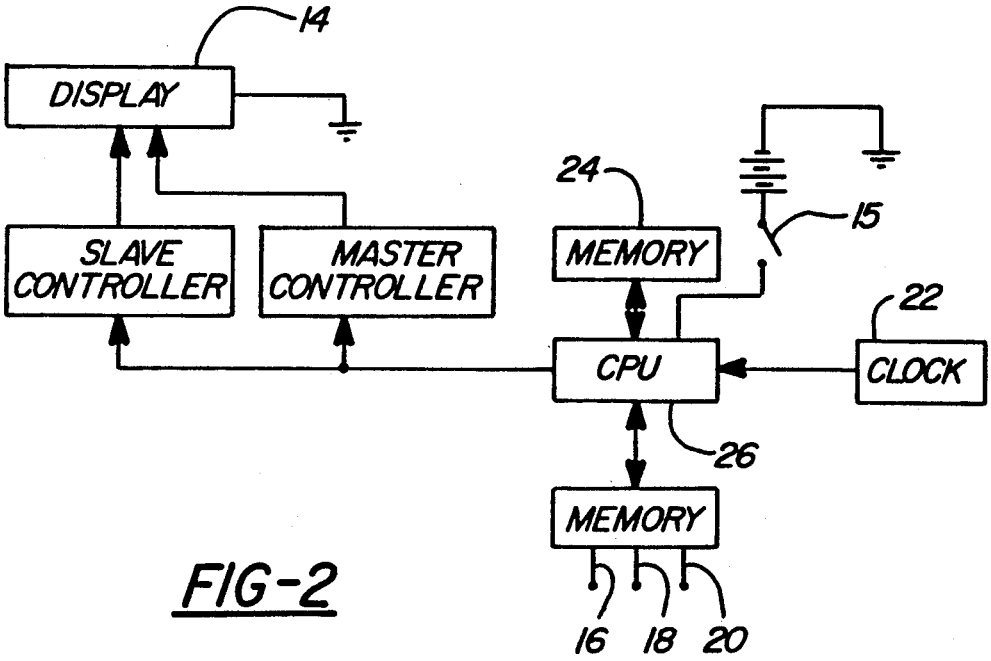
FIG. 2 is a block diagram showing the interrelationships of the physical components of the embodiment depicted in FIG. 1.

Throughout the following detailed description, like reference numerals are used to refer to the same element of the invention shown in multiple figures thereof. Referring now to the drawings, and in particular to FIGS. 1 and 2, there is depicted an examination timer 10 according to the present invention which includes a compact housing 12 constructed of a suitable waterproof, shock-resistant thermo plastic material. The housing 12 contains and protects the internal structures of the exam timer 10. The housing 12 has means forming a window 13 through which a display 14 may be observed. Preferably, display 14 is in the form of an LCD display, but any type of suitable display may be used, such as an LED display, etc.

As can be seen in FIG. 1, the display 14 includes in its upper left corner four numerals indicative of the current time (10:30 in the example), and a "p.m." indicator to tell the observer whether it is before or after 12:00 noon. In the example shown in FIG. 1, the p.m. indicator is active thereby indicating that the time is 10:30 at night. The display 14 further includes a RUN/SET mode indicator in its upper right corner. As shown in FIG. 1, the "RUN" portion of the indicator is activated, thereby indicating that the timer 10 is in the run mode. If the "SET" portion were activated, the word "set" would appear in the upper right corner of the display 14, thereby indicating that the timer 10 is in the SE mode.

The lower left corner of display 14 further includes numerals which indicate the number of questions in the exam. This set of numerals includes three digits so that any number of questions up to 999 may be entered into the device 10. In the example shown in FIG. 1, the examinee should have answered 15 questions at this point in the examination.

The display 14 of the present invention further includes, in its lower right corner, three numerals which indicate the time left until the end of the exam. The left most digit corresponds to hours, and the other two digits to minutes. Thus, any time period up to 9 hours and 59 minutes may be entered into the device of the present invention. In the example, it may be ascertained that 38 minutes remain in the examination.

The examination timer 10 further includes a plurality of switches 15, 16, 18, 20. Switch 15 is, as can be seen in FIG. 2 is a simple, bipolar power switch which selectively places the components of the present invention, schematically illustrated in FIG. 2, in communication with a source of electrical power, typically one or more dry cell batteries, or an adapter (not shown) connected to a source of household current.

Switches 16, 18, 20, which, preferably, are membrane switches and, therefore, flush with the outside surface of housing 12, are used to set and operate the timing device 10. Switch 16 is a mode switch which is used to change the device 10 from a SET mode to a RUN mode, and vice versa. Switch 18 is a start switch and switch 20 is a stop switch. Switches 18, 20 are used to start and stop the setting and running of the device 10 when it is in both of these modes. Switches 18, 20 also have another function, namely that of incrementing and decrementing time and number signals indicative of the time interval allocated for the exam and the total number of examination questions which are inputted by the operator into the memory 24, as is shown in FIG. 2. That is, when the device 10 is put into the setting mode and setting is started, the numerical values of all the displays are initialized to zero. Successive presses of the start button 18 will cause that digit of the display 14 which is being set to increment by one each time switch 18 is depressed, and successive depressions of the switch 20 will cause the display 14 to decrement the particular digit by one each time 20 is depressed.

Figure 3:
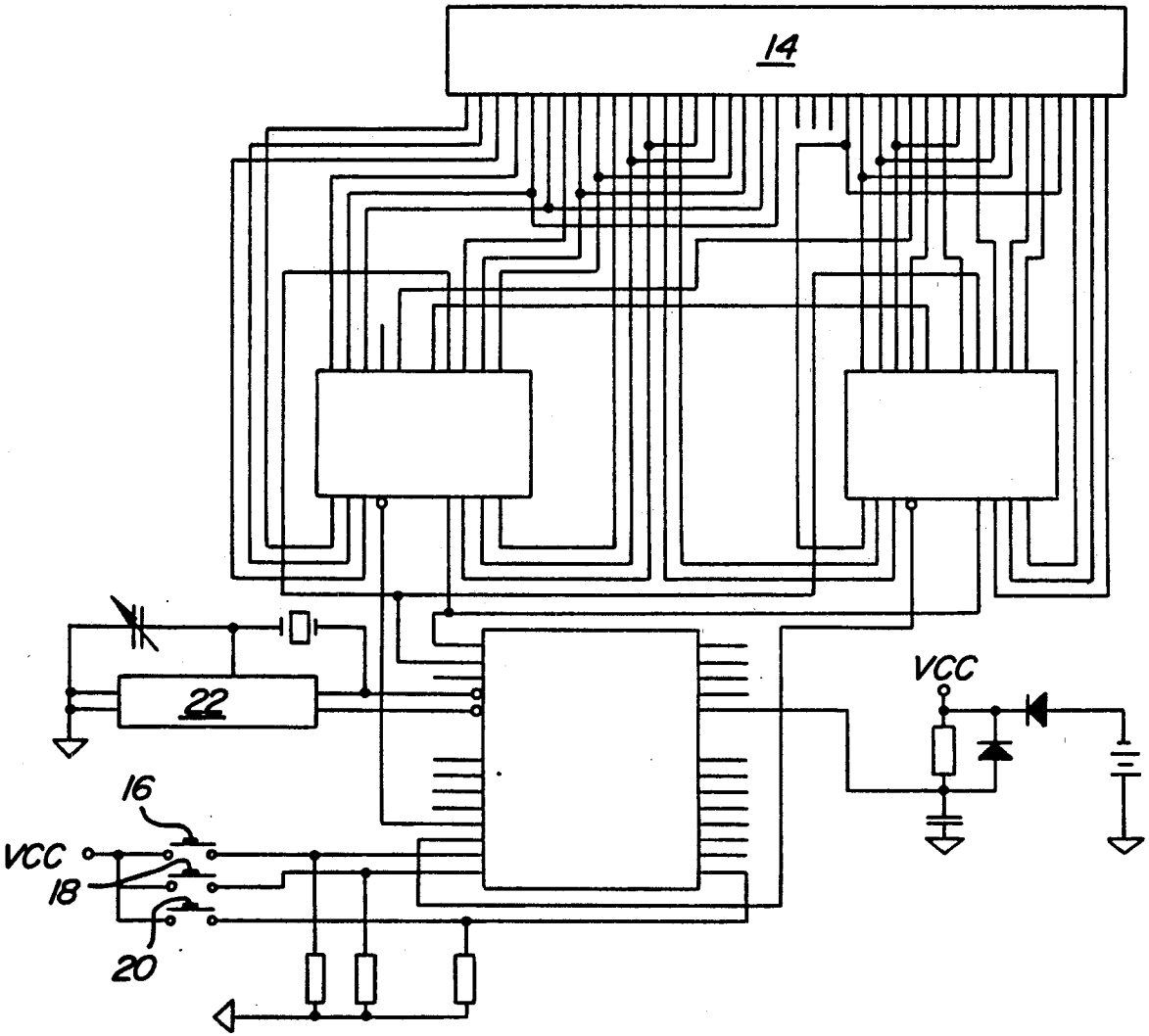
FIG. 3 is a circuit diagram of a circuit suitable for use in the device of the present invention.
Figure 4:
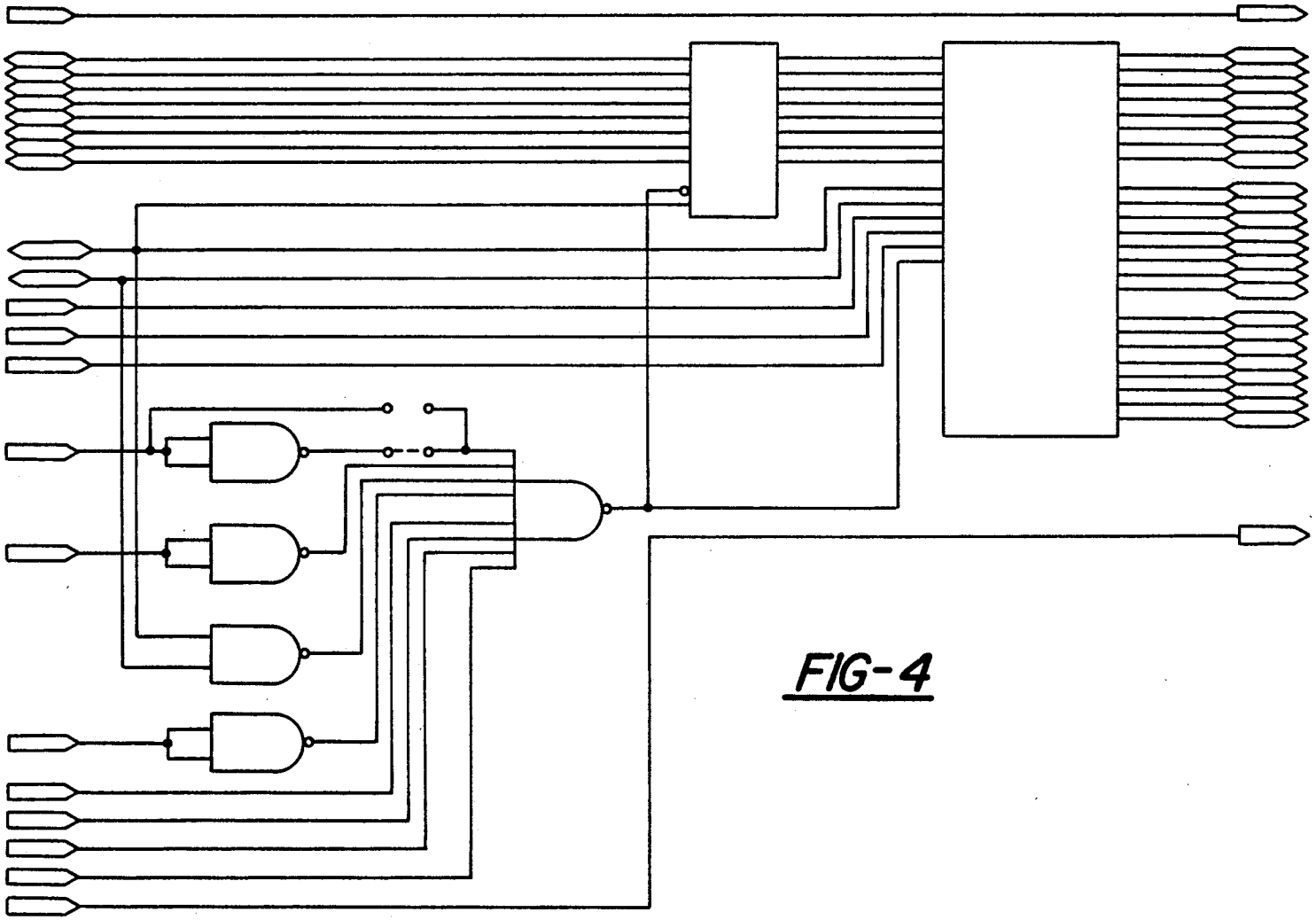
FIG. 4 depicts a circuit useful for downloading information into the memory of the device shown in FIG. 1.

FIGS. 3 and 4 depict schematically, respectively, a circuit useful for constructing the device 10 of the present invention, and a circuit useful for downloading information into the memory 24, which is, typically, static RAM. In FIG. 3, switches 16, 18 and 20 each further include a 10 K resistor across the circuit to prevent dangerous current overload. Clock 22 is used to generate and constantly update a real time signal, in a manner well known in the art.

The manner of operation of the exam timer 10 of the present invention will now be described. In the embodiment shown in FIG. 1, power switch 15 is switched to connect the circuitry to the source of power, thus activating the timer. At this initial stage, all of the numerical values which appear on display 14 are set at an initialized zero, except for the current time display, which is initialized to 12:00. In order to set the current time, the number of questions, and the total time allocated for the examination, switches 16 and 18 are pushed in rapid sequence to place the device 10 in the setting mode. At that time SET indicator will display and the left two digits of the current time display, shown in the upper left corner of display 14, will be initialized to 12 and will be flashing. These two digits correspond to the hour of the current time period. Switches 18, 20 are then used to increment or decrement the hour digits until the current hour time appears.

Switch 16 is then depressed once to set the hour at that time, at which time the right most two digits of the current time display will begin flashing. Buttons 18, 20 are then used to increment or decrement these digits until the current minute time is reached. Switch 16 is then depressed once to set the minute time. At that time, the SET indicator on the mode portion of the display shown in the upper right corner of display 14 will deactivate. The device 10 may then be used as a simple clock by depression of the start button In order to input the number of questions and the time allocated for the exam, the operator depresses switch 16 continuously for a few seconds. The SET indicator will again go on, and the left most digit of the question portion of the display will flash. Again, the correct value may be set by successive depressions of switches 18, 20. When the correct value is reached, switch 16 is depressed to set that value. The middle digit of the three digits in the questions portion of the display 14 will then flash, and may be set a in similar manner. After the middle digit has been set, the rightmost digit will flash and may be set in a similar manner. After all of the three question digits have been set, the hour digit of the time left portion of the display 14, which appears in the lower right corner, will begin flashing. The operator then enters the number of hours allocated for the exam by manipulating switches 16, 18, 20 in the same manner as was described for the setting of the current time display. After the number of hours has been set, the minute portion of the time left display will begin flashing and may be set as described above.

After all of these values has been inputted by the operator, switch 20 is depressed to signal to the CPU 26 that no more values are to be inputted. The RUN indicator in the upper right corner will then begin flashing. At that point, depression of start switch 18 will put the device 10 into the running mode and the RUN indicator will display continuously. The CPU 26, which serves as the controller, has calculated a response time in which to answer each question which is stored in memory 26. As soon as the device 10 is put in the running mode as described above, the CPU 24 will begin successively decrementing the stored time period allocated for the exam with the response time for as many times as it takes until the time interval equals zero. These decremented time intervals will successively and continuously appear on the display 14. When the value reaches zero, the exam will be over.

Each time the CPU decrements the exam time interval by the response time, it also increments the number of questions stored in the memory by one. This successively incremented value will continuously appear on the display 14. Thus, when the time interval allocated for the examination has completely elapsed, the number of questions appearing on the display 14 will equal the total number of questions in the exam.

In the example shown in FIG. 1, the device is in the RUN mode and the current time is 10:30 p.m. There are 38 minutes left in the examination, and the examinee should be answering question number 15. If the examinee has not reached question 15, then the examinee must increase her pace to complete the examination on time. Conversely, if the examinee has answered more than 15 questions, he knows he is ahead of the ideal pace. Thus, by consulting the exam timer 10 of the present invention during an examination, an examinee may be kept aware of how far ahead or behind she is off an ideal pace which allows the examinee to finish the examination exactly on time. The examinee may also determine at a glance how much time remains in the examination.

When the power switch 15 is switched off, power will be cut off in the embodiment depicted in the figures. Thus, it is necessary to reset the current time each time the device is switched on. However, the device of the present invention may be constructed without a power switch; it will run all of the time. It may employ a different power source and/or different circuitry such that only the current time clock will remain in operation at all times. Furthermore, one skilled in the art could employ a different number or type of switches for setting and operating the device, and could employ the switches in a different manner than described above. Clearly, all such alterations and modifications are contemplated by the teachings of the present invention, and the description of that invention by reference to the particular embodiments and exemplifications shown herein should not be construed to limit the claims of the present invention. It is the claims, and all equivalents thereof, which define the scope of the present invention.

I claim:

1. A timing device for pacing an examinee through an examination having a number of questions and a time interval in which to answer the questions, said timing device comprising:

A) clock means for generating a real time signal indicative of the present time;

B) operator controlled input means for entering a plurality of signals corresponding to the number of questions and the time interval;

C) memory means for storing said plurality of signals;

D) control means connected to said clock means, said memory means, and said input means, said control means being operative to :

i) determine a response time in which to answer each of the questions by dividing the time interval by the number of questions;

ii) successively decrement the time interval by the response time until the time interval equals zero;

iii) successively increment the number of questions by one each time the time interval is decremented;

iv) successively generate time signals corresponding to the successively decremented time intervals; and v) successively generate number signals corresponding to the successively incremented number of questions; and E) display means in communication with said control means for displaying the time and number signals successively generated by the control means such that the examinee may determine from the display means the time interval remaining until the examination is over and the question number he/she should be answering in order to complete the examination on time.

2. The timing device of claim 1 wherein the operator controlled input means further includes means for entering a plurality of signals corresponding to the current time, the control means is further operative to continuously update the inputted current time signals, and the display means further includes means for displaying the continuously updated current time signals.

3. The device of claim 1 wherein the display means further comprises LCD means for continuously displaying a digital read-out of the continuously generated time and number signals.

4. The device of claim 1 wherein the clock means, the memory means, the control means and the display means further comprise an integrated circuit.

5. The device of claim 4 further comprising a housing for containing and protectively encasing said integrated circuit.

6. The device of claim 5 wherein the housing further comprises a window through which said display means may be observed.

7. The device of claim 1 wherein the input means further comprises a plurality of switches.

8. The device of claim 1 further comprising switch means in communication with the control means wherein the control means begins successively decrementing the time interval and incrementing the number of questions upon activation of the switch.

9. The device of claim 8 further comprising a mode switch for switching the device between a setting mode, to permit entry of said plurality of signals, and a running mode, to permit entry of a start signal from activation of the start switch.

10. A timing device for pacing an examinee through an examination having a number of questions and a time interval in which to answer the questions, said timing device comprising:

A) clock means for generating a real time signal indicative of the present time;

B) operator controlled input means for entering a plurality of signals corresponding to the current time, the number of questions and the time interval;

C) memory means for storing said plurality of signals;

D) control means connected to said clock means, said memory means, and said input means, said control means being operative to:

i) continuously update the current time signal;

ii) determine a response time in which to answer each of the questions by dividing the time interval by the number of questions;

iii) successively decrement the time interval by the response time until the time interval equals zero;

iv) successively incremented the number of questions by one each time the time interval is decremented;

v) successively generate time signals corresponding to the successively decremented time intervals; and vi) successively generate number signals corresponding to the successively incremented number of questions;

E) switch means in communication with the control means, activation of which causes the control means to begin successively decrementing the time interval and incrementing the number of questions;

F) display means in communication with said control means for displaying the continuously updated current time signal, and the time and number signals successively generated by the control means such that the examinee may determine from the display means the current time, the time interval remaining until the examination is over and the question number he/she should be answering in order to complete the examination on time.

11. The device of claim 10 wherein the display means further comprises LCD means for continuously displaying a digital read-out of the continuously generated time and number signals.

12. The device of claim 10 wherein the clock means, the memory means, the control means and the display means further comprise an integrated circuit.

13. The device of claim 12 further comprising a housing for containing and protectively encasing said integrated circuit.

14. The device of claim 13 wherein the housing further comprises a window through which said display means may be observed.

15. The device of claim 10 wherein the input means further comprises a plurality of switches.

16. The device of claim 10 further comprising a mode switch for switching the device between a setting mode, the permit entry of said plurality of signals, and a running mode, to permit entry of a start signal from activation of the start switch.

17. A timing device for pacing an examinee through an examination having a number of questions and a time interval in which to answer the questions, said timing device comprising:

A) clock means for generating a real time signal indicative of the present time;

B) operator controlled input means for entering a plurality of signals corresponding to the current time, the number of questions and the time interval;

C) memory means for storing said plurality of signals;

D) control means connected to said clock means, said memory means, and said input means, said control means being operative to:

i) continuously update the current time signal;

ii) determine a response time in which to answer each of the questions by dividing the time interval by the number of questions;

iii) successively decrement the time interval by the response time until the time interval equals zero;

iv) successively increment the number of questions by one each time the time interval is decremented;

v) successively generate time signals corresponding to the successively decremented time intervals; and vi) successively generate number signals corresponding to the successively incremented number of questions;

E) switch means in communication with the control means, activation of which causes the control means to begin successively decrementing the time interval and incrementing the number of questions;

F) a mode switch for switching the device between a setting mode, to permit entry of said plurality of signals, and a running mode, to permit entry of a start signal from activation of the start switch; and G) display means in communication with said control means for displaying the continuously updated current time signal, and the time and number signals successively generated by the control means such that the examinee may determine from the display the current time, means the time interval remaining until the examination is over and the question number he/she should be answering in order to complete the examination on time.

18. The device of claim 10 wherein the display means further comprises LCD means for continuously displaying a digital read-out of the continuously generated time and number signals.

19. The device of claim 17 wherein the clock means, the memory means, the control means and the display means further comprise an integrated circuit.

20. The device of claim 19 further comprising a housing for containing a protectively encasing said integrated circuit.

* * * * *